US008475637B2

(12) United States Patent
Feng et al.

(10) Patent No.: US 8,475,637 B2
(45) Date of Patent: Jul. 2, 2013

(54) ELECTROPLATING APPARATUS WITH VENTED ELECTROLYTE MANIFOLD

(75) Inventors: Jingbin Feng, Lake Oswego, OR (US); Zhian He, Tigard, OR (US); Robert Rash, Portland, OR (US); Steven T. Mayer, Lake Oswego, OR (US)

(73) Assignee: Novellus Systems, Inc., San Jose, CA (US)

( * ) Notice: Subject to any disclaimer, the term of this patent is extended or adjusted under 35 U.S.C. 154(b) by 605 days.

(21) Appl. No.: 12/337,147

(22) Filed: Dec. 17, 2008

(65) Prior Publication Data

US 2010/0147679 A1 Jun. 17, 2010

(51) Int. Cl.
*C25D 17/00* (2006.01)
*C25D 21/04* (2006.01)

(52) U.S. Cl.
USPC ..... 204/278.5; 205/291

(58) Field of Classification Search
USPC ..... 204/275.1, 278.5; 205/80–333
See application file for complete search history.

(56) References Cited

U.S. PATENT DOCUMENTS 2,695,269 A * 11/1954 De Witz et al. ..... 204/206
3,450,625 A 6/1969 Ramsey et al.
3,652,442 A 3/1972 Powers et al.
3,706,651 A 12/1972 Leland
3,862,891 A 1/1975 Smith
4,033,833 A 7/1977 Bestel et al.
4,073,708 A 2/1978 Hicks et al.
4,082,638 A 4/1978 Jumer
4,240,886 A 12/1980 Hodges et al.
4,272,335 A 6/1981 Combs
4,304,641 A 12/1981 Grandia et al.
4,389,297 A 6/1983 Korach (Continued)

FOREIGN PATENT DOCUMENTS

EP 0037325 10/1981
JP 59-162298 9/1984

(Continued)

OTHER PUBLICATIONS

Andryuschenko et al., "Electroless and Electrolytic Seed Repair Effects on Damascene Feature Fill," Proceedings of International Interconnect Tech. Conf., San Francisco, California, Jun. 4-6, 2001 pp. 33 and 35.

(Continued)

*Primary Examiner* — Nicholas A Smith
*Assistant Examiner* — Ciel Thomas
(74) *Attorney, Agent, or Firm* — Knobbe Martens Olson & Bear LLP

(57) ABSTRACT

Embodiments related to increasing a uniformity of an electroplated film are disclosed. For example, one disclosed embodiment provides an electroplating apparatus comprising a plating chamber, a work piece holder, a cathode contact configured to electrically contact a work piece, and an anode contact configured to electrically contact an anode disposed in the plating chamber. A diffusing barrier is disposed between the cathode contact and the anode contact to provide a uniform electrolyte flow to the work piece, and electrolyte delivery and return paths are provided for delivering electrolyte to and away from the plating chamber. Additionally, a vented electrolyte manifold is disposed in the electrolyte delivery path immediately upstream of the plating chamber, the vented electrolyte manifold comprising one or more electrolyte delivery openings that open to the plating chamber and one or more vents that open to a location other than the plating chamber.

24 Claims, 8 Drawing Sheets

U.S. PATENT DOCUMENTS

| | | | |
|---|---|---|---|
| 4,409,339 | A | 10/1983 | Matsuda et al. |
| 4,469,564 | A | 9/1984 | Okinaka et al. |
| 4,545,877 | A | 10/1985 | Hillis |
| 4,604,177 | A | 8/1986 | Sivilotti |
| 4,604,178 | A | 8/1986 | Fiegener et al. |
| 4,605,482 | A | 8/1986 | Shiragami et al. |
| 4,696,729 | A | 9/1987 | Santini |
| 4,828,654 | A | 5/1989 | Reed |
| 4,906,346 | A | 3/1990 | Hadersbeck et al. |
| 4,931,149 | A | 6/1990 | Stierman et al. |
| 4,933,061 | A | 6/1990 | Kulkarni et al. |
| 4,988,417 | A | 1/1991 | DeYoung |
| 5,035,784 | A | 7/1991 | Anderson et al. |
| 5,039,381 | A | 8/1991 | Mullarkey |
| 5,096,550 | A | 3/1992 | Mayer et al. |
| 5,146,136 | A | 9/1992 | Ogura et al. |
| 5,151,168 | A | 9/1992 | Gilton et al. |
| 5,156,730 | A | 10/1992 | Bhatt et al. |
| 5,162,079 | A | 11/1992 | Brown |
| 5,217,586 | A | 6/1993 | Datta et al. |
| 5,221,449 | A | 6/1993 | Colgan et al. |
| 5,281,485 | A | 1/1994 | Colgan et al. |
| 5,316,642 | A | 5/1994 | Young, Jr. et al. |
| 5,332,487 | A | 7/1994 | Young, Jr. et al. |
| 5,368,711 | A | 11/1994 | Poris |
| 5,391,285 | A | 2/1995 | Lytle et al. |
| 5,421,987 | A | 6/1995 | Tzanavaras et al. |
| 5,443,707 | A | 8/1995 | Mori |
| 5,472,592 | A | 12/1995 | Lowery |
| 5,476,578 | A | 12/1995 | Forand et al. |
| 5,482,611 | A | 1/1996 | Helmer et al. |
| 5,498,325 | A | 3/1996 | Nishimura et al. |
| 5,516,412 | A | 5/1996 | Andricacos et al. |
| 5,567,300 | A | 10/1996 | Datta et al. |
| 5,576,052 | A | 11/1996 | Arledge et al. |
| 5,674,787 | A | 10/1997 | Zhao et al. |
| 5,697,559 | A | 12/1997 | Davis et al. |
| 5,723,028 | A | 3/1998 | Poris |
| 5,824,599 | A | 10/1998 | Schacham-Diamand et al. |
| 5,891,513 | A | 4/1999 | Dubin et al. |
| 5,913,147 | A | 6/1999 | Dubin et al. |
| 5,935,402 | A | 8/1999 | Fanti |
| 5,938,845 | A | 8/1999 | Ang |
| 5,969,422 | A | 10/1999 | Ting et al. |
| 5,972,192 | A | 10/1999 | Dubin et al. |
| 5,985,762 | A | 11/1999 | Geffken et al. |
| 6,027,631 | A | 2/2000 | Broadbent |
| 6,056,215 | A | 5/2000 | Hansinger et al. |
| 6,065,424 | A | 5/2000 | Shacham-Diamand et al. |
| 6,074,544 | A | 6/2000 | Reid et al. |
| 6,093,453 | A | 7/2000 | Ang |
| 6,099,702 | A | 8/2000 | Reid et al. |
| 6,110,346 | A | 8/2000 | Reid et al. |
| 6,124,203 | A | 9/2000 | Joo et al. |
| 6,126,798 | A | 10/2000 | Reid et al. |
| 6,132,587 | A | 10/2000 | Jorné et al. |
| 6,136,707 | A | 10/2000 | Cohen |
| 6,139,712 | A | 10/2000 | Patton et al. |
| 6,156,167 | A | 12/2000 | Patton et al. |
| 6,159,354 | A | 12/2000 | Contolini et al. |
| 6,162,344 | A | 12/2000 | Reid et al. |
| 6,179,973 | B1 | 1/2001 | Lai et al. |
| 6,179,983 | B1 | 1/2001 | Reid et al. |
| 6,193,854 | B1 | 2/2001 | Lai et al. |
| 6,193,860 | B1 | 2/2001 | Weling |
| 6,197,181 | B1 | 3/2001 | Chen |
| 6,217,716 | B1 | 4/2001 | Lai |
| 6,221,757 | B1 | 4/2001 | Schmidbauer et al. |
| 6,251,242 | B1 | 6/2001 | Fu et al. |
| 6,251,255 | B1 | 6/2001 | Copping et al. |
| 6,274,008 | B1 | 8/2001 | Gopalraja et al. |
| 6,277,249 | B1 | 8/2001 | Gopalraja et al. |
| 6,368,475 | B1 | 4/2002 | Hanson et al. |
| 6,391,166 | B1 | 5/2002 | Wang |
| 6,391,188 | B1 | 5/2002 | Goosey |
| 6,395,152 | B1 | 5/2002 | Wang |
| 6,402,923 | B1 | 6/2002 | Mayer et al. |
| 6,497,801 | B1 | 12/2002 | Woodruff et al. |
| 6,503,376 | B2 | 1/2003 | Toyoda et al. |
| 6,527,920 | B1 | 3/2003 | Mayer et al. |
| 6,576,110 | B2 | 6/2003 | Maydan |
| 6,664,122 | B1 | 12/2003 | Andryuschenko et al. |
| 6,713,122 | B1 * | 3/2004 | Mayer et al. ..... 216/13 |
| 6,755,954 | B2 | 6/2004 | Mayer et al. |
| 6,773,571 | B1 | 8/2004 | Mayer et al. |
| 6,783,611 | B2 | 8/2004 | Yajima et al. |
| 6,815,349 | B1 | 11/2004 | Minshall et al. |
| 6,821,407 | B1 | 11/2004 | Reid et al. |
| 6,890,416 | B1 * | 5/2005 | Mayer et al. ..... 205/261 |
| 6,919,010 | B1 | 7/2005 | Mayer |
| 6,964,792 | B1 | 11/2005 | Mayer et al. |
| 7,070,686 | B2 | 7/2006 | Contolini et al. |
| 7,147,765 | B2 * | 12/2006 | Klocke et al. ..... 204/623 |
| 7,169,705 | B2 | 1/2007 | Ide et al. |
| 7,223,690 | B2 * | 5/2007 | Kondo et al. ..... 438/637 |
| 7,622,024 | B1 | 11/2009 | Mayer et al. |
| 7,967,969 | B2 | 6/2011 | Mayer et al. |
| 2002/0017456 | A1 * | 2/2002 | Graham et al. ..... 204/275.1 |
| 2002/0020627 | A1 | 2/2002 | Kunisawa et al. |
| 2003/0102210 | A1 | 6/2003 | Woodruff |
| 2005/0000818 | A1 * | 1/2005 | Graham et al. ..... 205/102 |
| 2006/0163058 | A1 * | 7/2006 | Watanabe ..... 204/286.1 |
| 2007/0238265 | A1 | 10/2007 | Kurashina et al. |

FOREIGN PATENT DOCUMENTS

| | | |
|---|---|---|
| JP | 09-53197 | 2/1997 |
| JP | 2001-316887 | 11/2001 |
| JP | 2003-268591 | 9/2003 |
| KR | 10-0707121 | 4/2007 |
| WO | WO 99/41434 | 8/1999 |
| WO | WO 99/47731 | 9/1999 |

OTHER PUBLICATIONS

Chen et al., "EDC Seed Layer for Inlaid Copper Metallisation," Semiconductor Fabtech—12th Edition, 5 pages, Jul. 2000.

Fang et al., "Uniform Copper Electroplating on Resistive Substrates," Abs. 167, 205th Meeting, © 2004 The Electrochemical Society, Inc., 1 page.

Malmstadt et al., "Microcomputers and Electronic Instrumentation: Making the Right Connections" American Chemical Society (1994) p. 255.

Moffat et al., "Superconformal Electrodeposition of Copper in 500-90 nm Features," Journal of the Electrochemical Society, 2000, vol. 147(12), pp. 4524-4535.

Reid et al., "Factors Influencing Fill of IC Features Using Electroplated Copper," Adv Met Conf Proc 1999, MRS 10 pages (2000).

Reid et al., "Optimization of Damascene Feature Fill for Copper Electroplating Process," Shipley Company, IITC 1999, 3 pages.

Reid et al., "Factors Influencing Damascene Feature Fill Using Copper PVD and Electroplating," Solid State Technology, Jul. 2000, www.solid-state.com, pp. 86-88, 92, 96, 98, and 103.

Ritzdorf et al., "Electrochemically Deposited Copper," Conference Proceedings ULSI XV 2000, Materials Research Society, pp. 101-107.

Shacham-Diamand et al., "Copper Electroless Deposition Technology for Ultra-Large-Scale-Integration (ULSI) Metallization," Microelectronic Engineering 33 (1997), pp. 47-58.

Takahashi, "Electroplating Copper into Resistive Barrier Films," Journal of the Electromechanical Society, 2000, vol. 147(4), pp. 1414-1417.

Office Action issued in U.S. Appl. No. 11/040,359 on Oct. 26, 2007.

Final Office Action issued in U.S. Appl. No. 11/040,359 on Jul. 25, 2008.

Office Action issued in U.S. Appl. No. 11/040,359 on Jan. 8, 2009.

Notice of Allowance issued in U.S. Appl. No. 11/040,359 on Jul. 20, 2009.

International Search Report and Written Opinion of the International Searching Authority for International Application No. PCT/US2010/037520 mailed on Jan. 12, 2011.

* cited by examiner

ELECTROPLATING APPARATUS WITH VENTED ELECTROLYTE MANIFOLD

BACKGROUND

Electroplating may be used in integrated circuit manufacturing processes to form electrically conductive structures. For example, in a copper damascene process, electroplating is used to form copper lines and vias within channels previously etched into a dielectric layer. In one example of such a process, an electrically conductive seed layer is first deposited into the channels and on the substrate surface, for example, via physical vapor deposition. Then, electroplating is used to deposit a thicker copper layer over the seed layer such that the channels are completely filled. Excess copper is then removed by chemical mechanical polishing, thereby forming the individual copper features.

As integrated circuit fabrication technologies advance, thinner and thinner seed layers are being used for electroplating processes. However, the use of thin seed layers may pose problems with the plating of a uniform film over the seed layer. For example, thinner seed layers can lead to a larger voltage drop between the electrical contacts that provide current to the seed layer and portions of the seed layer that are remote from the contacts. Because electrical contacts are generally made to a seed layer on a wafer at locations adjacent to an outer edge of the wafer, a significant voltage drop may exist between the edge of the wafer and the center of the wafer due to the thinness of the seed layer. This may cause higher film growth rates near the wafer perimeter than near the wafer center.

Various approaches have been employed to overcome such difficulties. For example, in one approach, segmented anodes comprising two or more anode sections with separately controllable potentials relative to the wafer surface (e.g. cathode) have been proposed to dynamically control plating rates on different regions of the wafer surface. Other approaches involve controlling the chemistry of the plating solution, for example, to increase a charge transfer resistance at the wafer-electrolyte interface via copper complexing agents or charge transfer inhibitors, to increase a resistance of the electrolyte surface by reducing an ionic conductivity of the plating solution, etc. These chemical approaches attempt to increase the resistance of other components of the plating circuit to reduce the effects of the seed layer resistance. However, the seed layer resistance of a thinly seeded wafer may be too high for such approaches to be effective. Further, various other factors may affect the uniformity of an electroplated film, including but not limited to electrolyte current uniformity, ionic current uniformity, the presence of bubbles in the electrolyte, etc.

SUMMARY

Accordingly, various embodiments related to increasing a uniformity of an electroplated film are disclosed. For example, one disclosed embodiment provides an apparatus for electroplating a layer of metal onto a conductive seed layer on a work piece. The disclosed apparatus comprises a plating chamber configured to hold an electrolyte, a work piece holder configured to hold a work piece in the plating chamber during an electroplating process, a cathode contact associated with the work piece holder and configured to electrically contact a the work piece during plating, and an anode contact configured to electrically contact an anode disposed in the plating chamber. Further, a diffusing barrier is disposed between the cathode contact and the anode, an electrolyte delivery path is provided for delivering electrolyte to the plating chamber, and an electrolyte return path is provided for delivering electrolyte away from the plating chamber. Additionally, a vented electrolyte manifold is disposed in the electrolyte delivery path upstream from the plating chamber, the vented electrolyte manifold comprising one or more electrolyte delivery openings that open to the plating chamber and one or more vents that open to a location other than the plating chamber.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
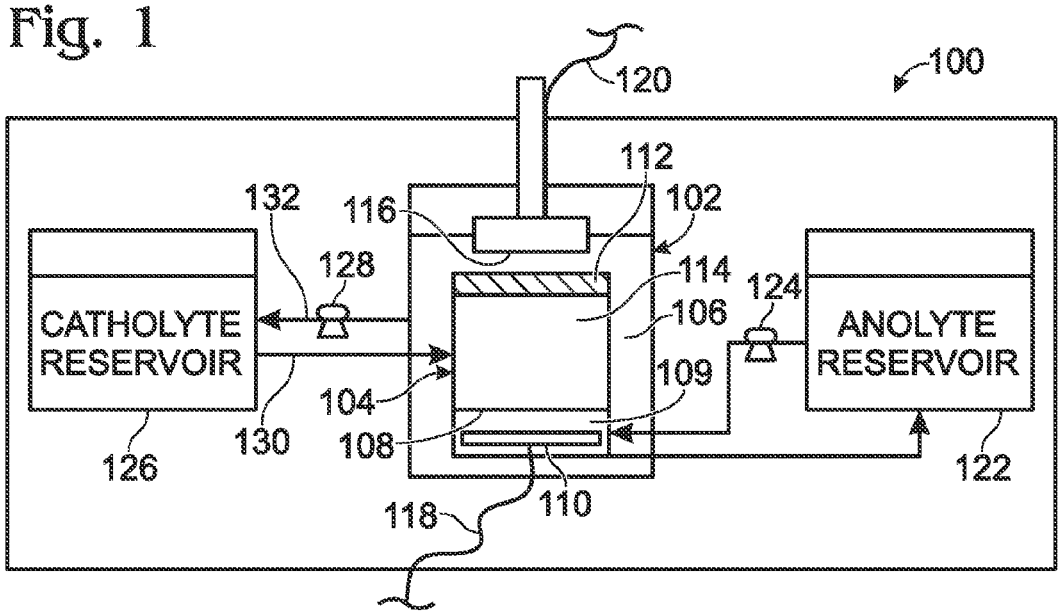
FIG. 1 shows a block diagram of an embodiment of a semiconductor electroplating system.

FIG. 1 shows a block diagram of an embodiment of a semiconductor electroplating system 100. Electroplating system 100 comprises an electroplating cell 102 with an anode chamber 104 and a cathode chamber 106, which may be collectively referred to as a plating chamber. The depicted anode chamber 104 is separated into two distinct portions by a selective transport barrier 108. One portion, referred to herein as a "separated anode chamber" (SAC) 109, contains the anode electrical contacts and anode, which are indicated schematically at 110. The other portion, which is separated by the selective transport barrier 108 from the SAC, is located between the selective transport barrier 108 and a diffuser barrier 112. The diffuser barrier 112 is configured to direct a uniform flow of electrolyte onto substantially an entire surface of a work piece, such as a semiconductor wafer. Further, as described in more detail below, the diffuser barrier 112 may be configured to direct a substantially uniform ionic current flow toward the work piece surface. The portion of the anode chamber 104 that is located between the selective transport barrier 108 and the diffuser barrier 112 may be referred to herein as a diffuser chamber 114.

The cathode chamber 106 is configured to accommodate a work piece holder that comprises one or more electrical contacts configured to provide a flow of current to a work piece acting as a cathode. The cathode contacts, work piece holder, and work piece are collectively indicated schematically at 116. In one embodiment, the cathode may take the form of an electrically conductive seed layer on a semiconductor wafer.

The anode chamber 104 comprises an anolyte solution 109 and the diffuser chamber 114 and the cathode chamber 106 each comprise a catholyte solution. During electroplating, an electric field is established between the anode 110 and the cathode 116. This field drives positive ions from the separated anode chamber 104 through the selective transport barrier 108, through the diffuser chamber 114, the diffuser barrier 112, into the cathode chamber 106 and to the cathode 116. At the cathode, an electrochemical reaction takes place in which metal cations are reduced to form a solid layer of the metal on the surface of the cathode 116. An anodic potential is applied to the anode 110 via an anode electrical connection 118, and a cathodic potential is provided to the cathode 116 via a cathode electrical connection 120. In some embodiments, the cathode 116 may be rotated during plating. While the diffuser barrier 112 and selective transport barrier 108 are depicted as being between the anode 110 and cathode 116 along a straight-line path between the electrodes, it will be understood that the path between the anode and the cathode in other embodiments may not be a straight-line. The description of the diffuser barrier and selective transport barrier as being between the anode and the cathode refers to herein as being along an ionic pathway between the electrodes, and does not imply any specific pathway shape or geometry between the electrodes.

The anolyte in the anode chamber 104 may be stored in and replenished from an anolyte reservoir 122. The temperature and composition of the anolyte may be controlled in the anolyte reservoir 122. Anolyte may be circulated through the anolyte reservoir 122 and the anode chamber 104 via, for example, a combination of gravity and one or more pumps 124. Likewise, the catholyte may be circulated from a catholyte reservoir 126 into the diffuser chamber 114, then the cathode chamber 106, and back to the catholyte reservoir 126 via, for example, a combination of gravity and one or more pumps 128.

The selective transport barrier 108 allows a separate chemical and/or physical environment to be maintained within the SAC 109 compared to the cathode chamber 106 and the diffuser chamber 114. For example, the selective transport barrier 108 may be configured to prevent non-ionic organic species from crossing the barrier while allowing metal ions to cross the barrier. The catholyte may contain various organic additives, such as levelers, accelerators and suppressors, that aid in plating copper onto the cathode 116 but that may poison the anode 110 or otherwise harm anode performance. Therefore, the selective transport barrier 108 may be configured to prevent such organic additives in the catholyte from contaminating the anolyte while allowing copper from the anolyte to reach the catholyte.

The selective transport barrier 108 may be made from any suitable material or materials. In some embodiments, the selective transport barrier may be made from a material or material that is porous and that allows passage of both anions and cations. Examples of suitable materials include, but are not limited to, porous glasses, porous ceramics (e.g. alumina and zirconia), silica aerogels, organic aerogels, and porous polymeric materials such as polyvinylidene flouride, sintered polyethylene or sintered polypropylene. In one specific embodiment, the selective transport barrier 108 comprises Nafion, available from E.I. DuPont De Nemours and Company of Wilmington, Del. In yet other embodiments, a multilayer structure comprising one or more layers of a material with smaller pores and one or more layers of a material with larger pores may be used.

The diffuser barrier 112 also may be made from any suitable material, and may have any suitable construction and location within the plating cell 102. As mentioned above, the diffuser barrier 112 is configured to create a uniform flow of electrolyte across the surface of a work piece during a plating process. Therefore, suitable materials include porous materials configured to allow passage of a desired flow rate of electrolyte. Examples of suitable materials include, but are not limited to, electrically insulating materials such as sintered plastics, porous ceramics, and sintered glasses.

In order for plating uniformity to benefit from the uniform flow emanating from the diffuser barrier 112, the surface of a work piece to be plated may be placed in close proximity to the diffuser barrier 112 during a plating process. In one specific embodiment, a wafer surface is placed within 5 mm or less of the diffuser barrier surface 112 during plating. In other embodiments, the diffuser barrier 112 may have any other suitable location.

In some embodiments, the diffuser barrier 112 may be configured to have a relatively low ionic resistance and low fluid resistance. In such embodiments, the diffuser barrier may have a void fraction of, for example, 10-70%. In other embodiments, the diffuser barrier 112 may be configured to have a relatively high fluid and ionic resistance. Where the diffuser barrier 112 is configured to have a higher ionic resistance, the diffuser barrier 112 may have either an interconnected network of pores or other internal passages (such that fluid and ionic current can flow in a radial direction relative to a surface of a work piece being plated), or may have non-interconnected pores or passages such that fluid and ionic current does not flow from pore to pore, but instead flows one-dimensionally through the diffuser barrier 112 in a direction defined by the direction of through-holed extending through the diffuser barrier 112. In some embodiments, such a diffuser barrier 112 may comprise a plate of an ionically resistive material, such as polyethylene, polypropylene, polyvinylidene difluoride (PVDF), polytetrafluoroethylene, polysulphone, etc.

In one example embodiment, a highly ionically resistive diffuser barrier 112 with one-dimensional through-holes for use in plating a 300 mm wafer comprises an ionically resistive disc having a thickness of 5-25 mm, with a shape and size co-extensive with the shape and size of the wafer. The disc comprises between 6,000 and 12,000 non-interconnected (i.e. "one-dimensional") through-holes, each with a diameter of a millimeter or less, formed through the plate in a direction normal to the major faces of the plate. Such a high-resistance, one-dimensional diffuser barrier may have a void fraction, for example of 5% or less. An ionically resistive, low-void fraction diffuser barrier such as the described example may be referred to herein as a "high resistance virtual anode" (HRVA), as the structure exhibits high ionic and fluidic resistance, and ionic current flow density from such a diffuser barrier approximates that from a uniformly charged anode of similar dimensions placed in a similar location. It will be understood that this diffuser plate embodiment is described for the purpose of example, and that a diffuser plate may have any other suitable construction and configuration.

It will be understood that the embodiment of FIG. 1 is presented for the purpose of example, and is not intended to be limiting in any manner. For example, other embodiments may omit a separated anode chamber. In these embodiments, a single electrolyte may circulate between an anode chamber and a cathode chamber through a diffusing barrier that separates the chambers, instead of separate anolyte and catholyte solutions. Therefore, in the discussion below of embodiments of vented manifolds, it will be understood that the term "electrolyte delivery path" may be used to generically describe a path 130 for delivering a suitable electrolyte solution to a chamber located upstream of a diffusing barrier (e.g. diffuser chamber 114 in FIG. 1), and that "electrolyte return path" may be used to generically describe a path 132 for returning electrolyte to a reservoir (e.g. catholyte reservoir 126 in FIG. 1) from a cathode chamber downstream of a diffuser barrier.

Figure 2:
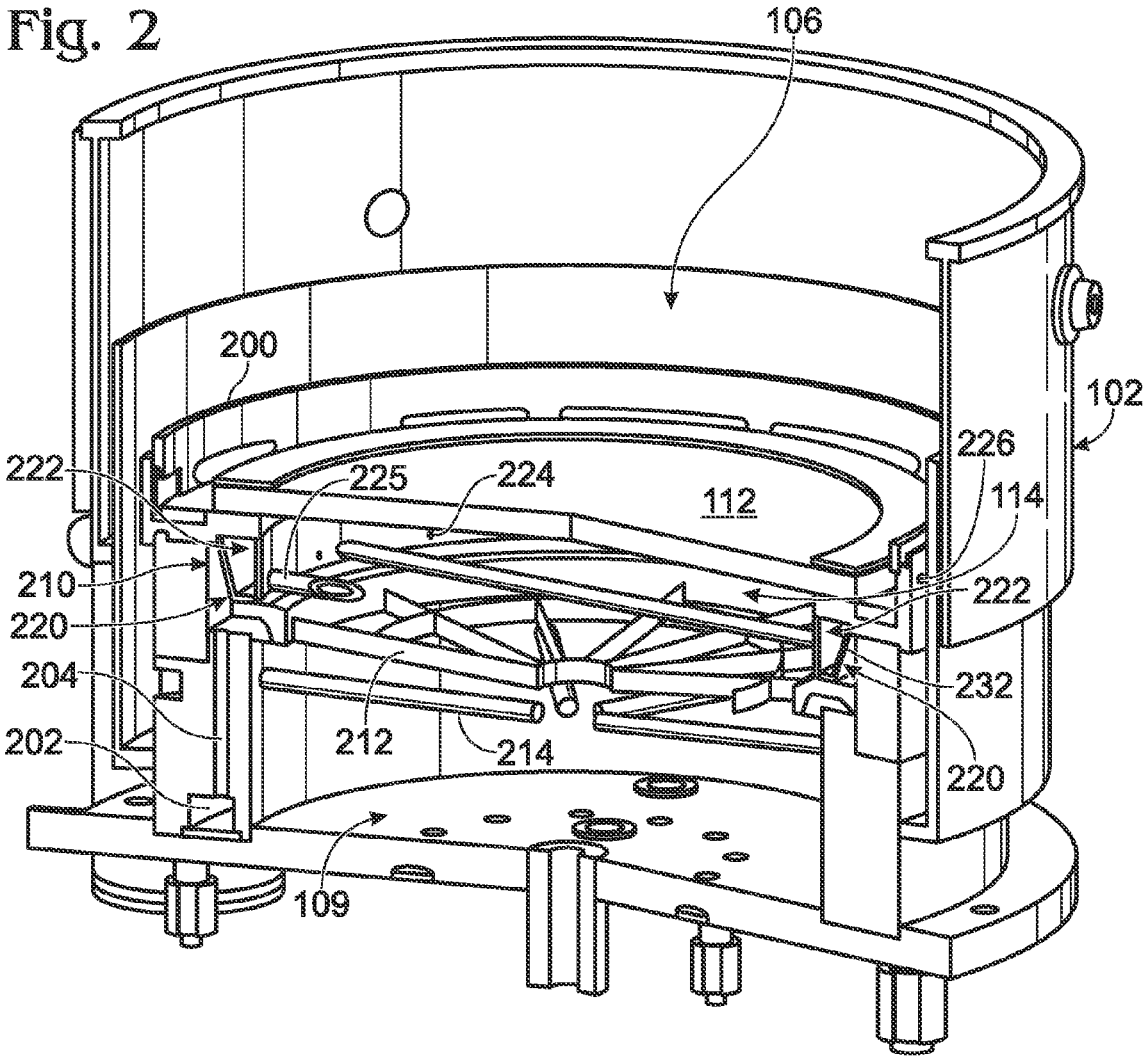
FIG. 2 shows a partially cut-away view of an embodiment of an anode chamber in an electroplating system.

FIG. 2 shows a more detailed view of the plating cell 102. During use, the plating cell 102 is filled with electrolyte up to a weir wall 200. Electrolyte intended for the diffuser chamber 114 first enters the plating cell 102 at a lower manifold 202. The electrolyte then flows from the lower manifold 202 through one or more electrolyte feed tubes 204 into a vented electrolyte manifold 210, then into the diffuser chamber 114, through the diffuser barrier 112, and then radially outward over the weir wall 200 to the electrolyte return path 132. In one specific embodiment, six electrolyte feed tubes 204 deliver electrolyte to the vented manifold 210, but it will be understood that any other suitable number of electrolyte feed tubes 204 may be used.

The anode chamber 104 may include an anode (not shown in FIG. 2) at a bottommost portion of the anode chamber, or in any other suitable location in the anode chamber 102. The selective transport membrane 108 (not shown in FIG. 2) dividing the SAC 109 from the diffuser chamber 114 may be supported by a frame 212. The SAC 109 may contain additional structures, such as flutes 214 for creating desired anolyte flow patters within the SAC 109. These and other structures of the SAC are not discussed in further detail herein.

The vented electrolyte manifold 210 is configured to vent bubbles out of the electrolyte before the electrolyte is introduced into the diffuser chamber 114. As described in more detail below, the introduction of bubbles into the diffuser chamber of a larger size than the through-holes in the diffuser barrier 112 may result in the bubbles being trapped beneath the diffuser barrier 112. These bubbles may block the flow of electrolyte through the diffuser barrier 112, and therefore may cause non-uniform plating to occur in the region of the work piece that is impacted by the blocked flow. Such problems may be particularly evident in the case of a one-dimensional HRVA, as the one-dimensional channels and the close proximity of a work piece to the HRVA during use prevent lateral electrolyte flow from compensating for the blocked electrolyte flow.

Bubbles may arise from various sources in an electroplating system. For example, bubbles can be formed by fluid returning from a plating cell agitating the surface of a reservoir/bath and being subsequently redirected back into the cell, air trapped in the electrolyte supply line and air trapped in the plating cell during the startup, small air leaks in the lines or cavitations on the negative pressure side of the pump that feed the electrolyte to the plating cell, release of gas from an electrolyte supersaturated under pressure at the pump, electrolytic gas generated at the anode, and various other mechanisms.

The vented electrolyte manifold 210 removes bubbles by establishing a suitably slow flow of electrolyte to allow any bubbles within a size range of concern to rise to the top of the manifold for removal via one or more vents located in the top of the manifold. The vented electrolyte manifold 210 may have any suitable configuration for removing bubbles in this manner. For example, the vented electrolyte manifold 210 may be configured to slow electrolyte flow and reduce turbulence in the electrolyte flow to thereby allow time for bubbles to rise out of the electrolyte and reach vents in the vented electrolyte manifold.

In the depicted embodiment, the vented manifold 210 comprises two fluid flow stages that are separated by a wall with one or more openings permitting electrolyte flow between the stages. As can be seen in FIG. 2, the electrolyte feed tubes 204 open into a first fluid flow stage, which is referred to herein as a "quiescent stage" 220 of the vented manifold 210. The quiescent stage 220 of the vented manifold has a larger cross-sectional area than the electrolyte feed tubes 204, and therefore permits the electrolyte flow to slow upon exiting the feed tubes 204. Suitable selection of the relative cross-sectional areas and fluid flow rates for these structures may allow turbulent flow from the electrolyte feed tubes to be converted to laminar flow prior to introduction into the second, "de-bubbler" stage 222 of the vented manifold. While the depicted embodiment comprises a two-stage vented manifold configuration, it will be understood that other embodiments may comprise a single-stage vented manifold in which electrolyte flows from the fed tubes into a single vented manifold chamber. Such a configuration may be used, for example, where electrolyte flow in the electrolyte feed tubes is laminar, rather than turbulent, or in any other suitable embodiment. Further, other embodiments may provide more than two manifold stages, for example, to lengthen an electrolyte flow distance between the manifold feed tubes 204 and the diffuser chamber 114.

The conversion of turbulent flow from the electrolyte feed tubes 204 to laminar flow in the quiescent stage 220 of the vented manifold may help to improve bubble separation compared to the turbulent flow in the electrolyte feed tubes 204, as bubbles may be poorly separated in turbulent flow. This may allow bubbles some time to separate and rise to a top portion of the vented manifold for removal in the de-bubbler stage 222.

From the quiescent stage 220, electrolyte flows into the de-bubbler stage 222. The de-bubbler stage 222 comprises one or more electrolyte delivery openings 224 and/or flow distribution tubes 225 that open to the diffuser chamber to deliver electrolyte to the diffuser chamber. The de-bubbler stage 222 also comprises one or more vents 226 that open to the electrolyte return path to allow a smaller flow of electrolyte to carry any separated bubbles directly to the electrolyte return path, rather than to the diffuser chamber. The locations of the terminal openings of the electrolyte delivery openings 224 and the vents 226 are shown in more detail in FIGS. 3-4. The vented electrolyte manifold 210 may have any suitable number of vents 226. In one specific embodiment, the vented electrolyte manifold 210 has six vents 226 spaced at regular intervals around the vented electrolyte manifold 210. It will be understood that this specific embodiment is described for the purpose of example, and is not intended to be limiting in any manner.

To facilitate bubble removal, the electrolyte delivery openings 224 may be located at a lower position in the vented electrolyte manifold than the vents 226. In the depicted embodiment, the electrolyte delivery openings 224 are located in or near a bottommost surface of the de-bubbler stage 222, while the vents 226 may be located in or near an uppermost surface of the de-bubbler stage 222. In this manner, bubbles that have risen in the electrolyte higher than a height of the electrolyte delivery openings 224 relative to the bottommost surface flow through the vents 226, rather than through the electrolyte delivery openings 224. As such, the vents 226 may be configured to pass a much smaller flow of electrolyte than the electrolyte delivery openings 224, yet a sufficient flow to assist with the venting of bubbles that collect and/or coalesce at the uppermost surface of the de-bubbler stage. Consideration of electrolyte flow rates, viscosity, manifold dimensions, etc. may allow the design of a vented electrolyte manifold 210 that provides sufficiently slow electrolyte flow to allow bubbles of specific sizes of concern to rise to the vents, and thereby avoid introduction into the diffuser chamber 114. Further, making the vented manifold integrated into the anode chamber and placing the de-bubbler stage immediately upstream of the diffuser chamber 114 (i.e. with no intermediary structures other than the outlets that pass electrolyte from the de-bubbler stage to the diffuser chamber through the wall of the vented manifold) decreases the likelihood that any new bubbles will form in the electrolyte as the electrolyte flows from the vented electrolyte manifold 112 to the diffuser barrier 112.

In the depicted embodiment, the de-bubbler stage 222 and the quiescent stage 220 each have a horizontally-oriented uppermost surface (i.e. parallel to the horizontal axis). However, in other embodiments, the uppermost surface of either or both of these sections may have a suitable incline or slope to direct bubbles toward the vents 226, or may have any other suitable configuration.

Figure 5:
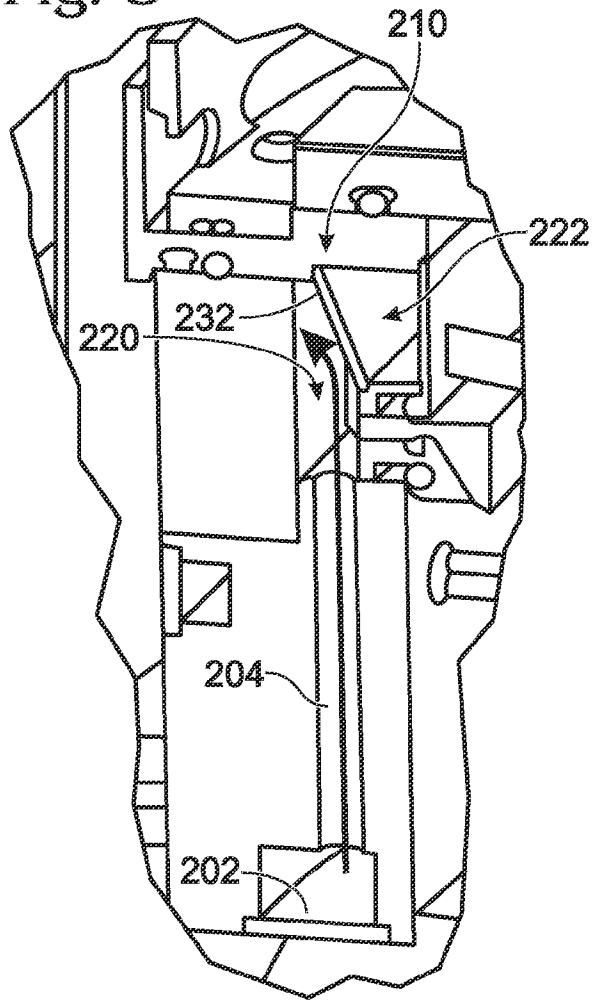
FIG. 5 shows a view of an electrolyte feed tube configured to deliver electrolyte to the vented electrolyte manifold of the embodiment of FIG. 2.

In the depicted embodiment, the quiescent stage 220 is separated from the de-bubbler stage 222 via a wall 232. The wall 232 slants at an angle outwardly as it rises up from the bottom to the top of the vented electrolyte manifold 210. In this manner, electrolyte flowing into the quiescent stage 220 from the electrolyte feed tubes 204 is deflected by the wall 232. This may help to slow the turbulent flow entering the quiescent state 220. The spatial relationship between an example electrolyte feed tube 204 and the wall 232 is shown in FIG. 5. The slanted configuration of wall 232 also may help to avoid trapping bubbles relative to the use of a wall that utilizes a vertical-to-horizontal right angle instead of a slanted configuration. However, it will be understood that walls of any other suitable configuration, including vertically oriented walls, may be used in other embodiments.

In order to allow sufficient time for bubbles of the sizes of concern to rise to the top of the electrolyte solution for removal through vents (described below) in the de-bubbler stage 222, the vented electrolyte manifold 210 may be configured to cause electrolyte to flow horizontally in an azimuthal direction for a sufficient distance to allow a desired bubble rise time to pass. During horizontal azimuthal flow, bubbles may tend to rise to the uppermost surface of the vented electrolyte manifold 210. The bubbles may subsequently coalesce with other bubbles, and eventually displace a sufficient volume to cover the opening of a vent 226 and then be redirected out of the de-bubbler stage 222 through the vent 226.

Figure 3:
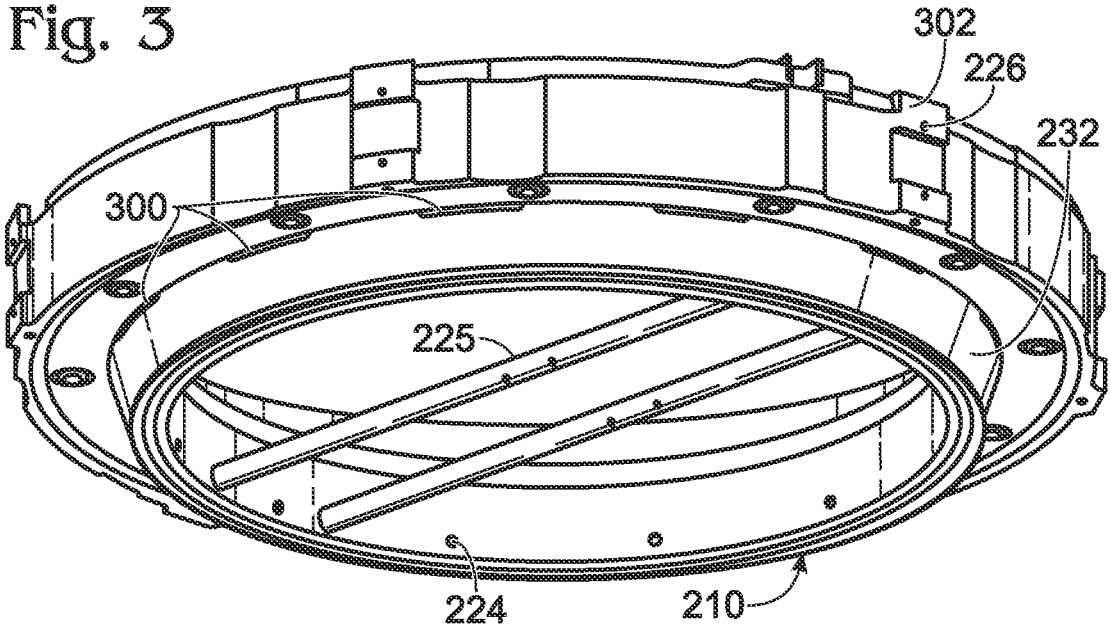
FIG. 3 shows a bottom perspective view of a vented electrolyte manifold of the embodiment of FIG. 2.
Figure 6:
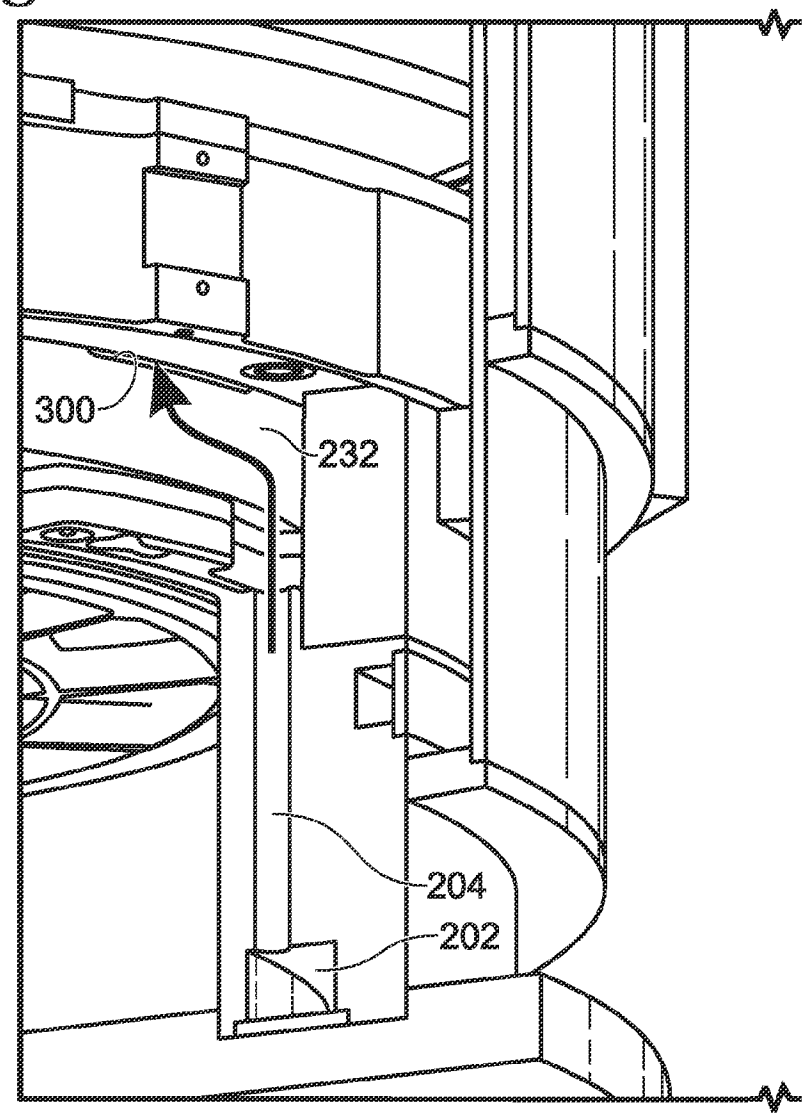
FIG. 6 shows another view of an electrolyte feed tube and vented electrolyte manifold of the embodiment of FIG. 2, and illustrates an azimuthal spacing between the electrolyte feed tube and a slot that opens between a quiescent stage and a de-bubbler stage of the vented electrolyte manifold.

The vented electrolyte manifold 210 may comprise any suitable structures configured to direct azimuthal electrolyte flow. For example, in the depicted embodiment, openings in the wall 224 between the quiescent stage 220 and the de-bubbler stage 222 are azimuthally spaced from the openings of the electrolyte feed tubes 204 into the quiescent stage 220. FIG. 3 shows an example embodiment of a plurality of openings 300 in wall 224 that allow passage of electrolyte from the quiescent state 220 to the de-bubbler stage 222. By locating the outflow of electrolyte from the electrolyte feed tubes 204 between adjacent openings 300, azimuthal electrolyte flow is created. Such an arrangement is depicted in FIG. 6, where azimuthal electrolyte flow is depicted in bold arrows. Further azimuthal flow may be created by locating the electrolyte delivery openings 224 and vents 226 at positions spaced azimuthally from the openings 300 between the quiescent stage 220 and the de-bubbler stage 222.

Figure 4:
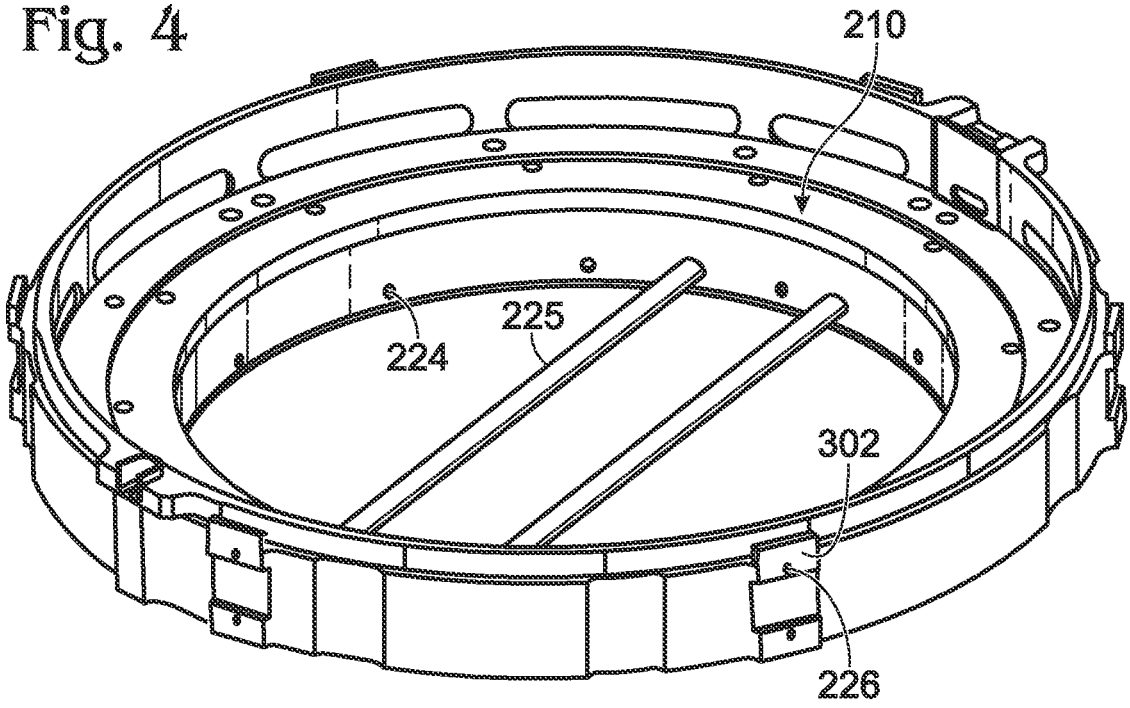
FIG. 4 shows a top perspective view of the vented electrolyte manifold of the embodiment of FIG. 2.
Figure 7:
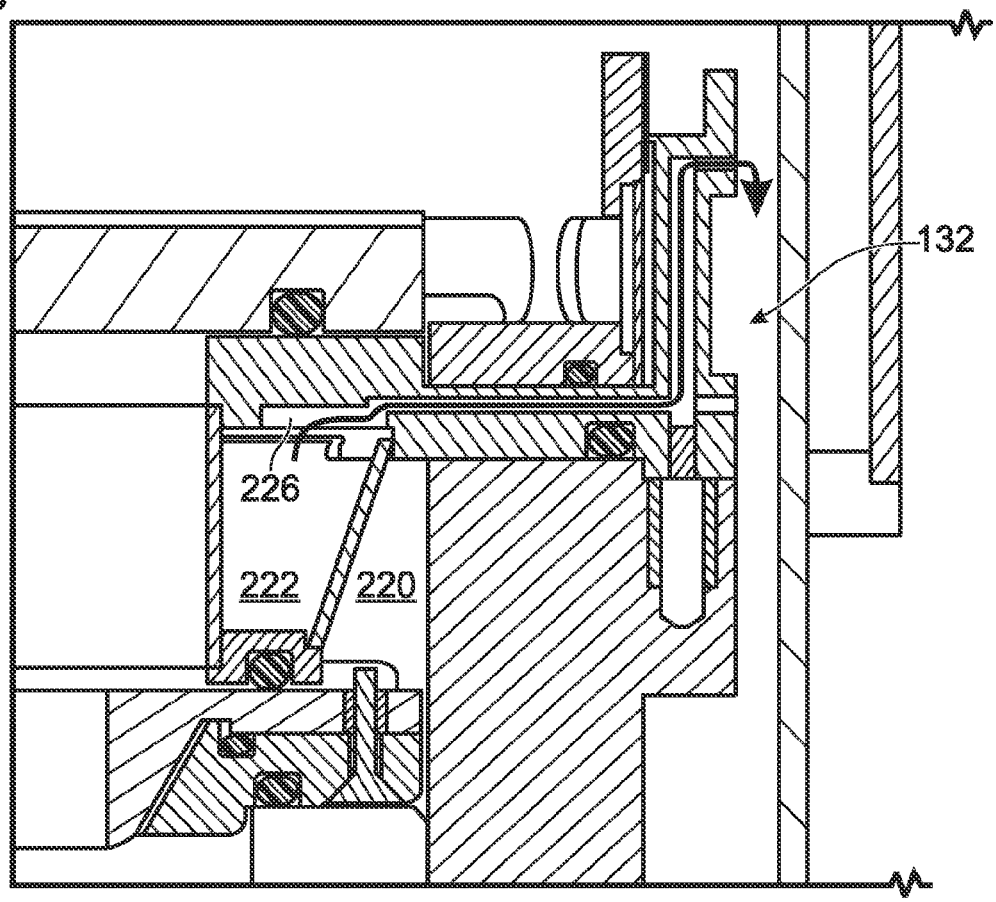
FIG. 7 shows a sectional view of the embodiment of FIG. 2, and illustrates a vent path that leads to an electrolyte return path.

Referring briefly back to FIGS. 3 and 4, these figures show an example of one embodiment of a terminal opening for vents 226, where the vents 226 terminate at tabs 302 that extend outwardly from an outer perimeter of the weir wall 200. FIG. 7 shows the path of a vent 226 from the de-bubbler stage 222 to the terminal opening depicted in FIGS. 3 and 4. This configuration may help to prevent any continuous flow of electrolyte from vents 226 from connecting with any continuous flow of electrolyte over the weir wall 200, and therefore may help to prevent ionic current from passing around the diffuser barrier 112 by flowing through vents 226 and over the weir wall 200 to the cathode 116. Further, the vents 226 may be configured to pass a much smaller flow of electrolyte than the electrolyte delivery openings 224. For example, in one specific embodiment, the vents 226 may pass 5% or less of the electrolyte flowing into the de-bubbler stage 222. This may allow the electrolyte to pass out of the vents 226 in a discontinuous, drop-wise manner, thereby further reducing the likelihood of forming an ionic short-circuit around an HRVA used as diffuser barrier 112. In the depicted embodiment, the vents 226 open to the electrolyte return path 132. However, the vents may open to any other suitable location.

It will be understood that the depicted tabs are shown to illustrate one potential embodiment for separating electrolyte flow from the vents 226 and electrolyte flow over the weir wall 200, and are not intended to be limiting in any manner. For example, in another embodiment, spacers such as ribs or walls may be provided between vents 226 and the regions of the weir wall 200 over which electrolyte from the cathode chamber flows. Likewise, a tube or other structure may be provided to route flow from each vent 226 away from the flow of electrolyte over the weir wall 200. In any of these cases, the vents are spaced from the outer perimeter of the weir wall, thereby separating electrolyte flow out of the vents from flow over the weir wall.

The use of vented electrolyte manifold 210 may offer advantages in any plating cell. For example, in plating cells without a diffuser barrier 112, bubbles that reach the cathode surface may cause the formation of plating defects at that location on the surface, as the bubble prevents ionic current from reaching the cathode area beneath the bubble. Further, as mentioned above, bubbles that become trapped beneath the diffuser barrier 112 may block fluid flow and ionic current through a portion the diffuser barrier 112. Such problems may be more apparent where a one-dimensional HRVA is used as a diffuser barrier 112, as the close proximity of the work piece to the HRVA during plating may prevent lateral plating fluid flow from adjacent HRVA through-holes from compensating for the lack of flow through the blocked holes.

Figure 8:
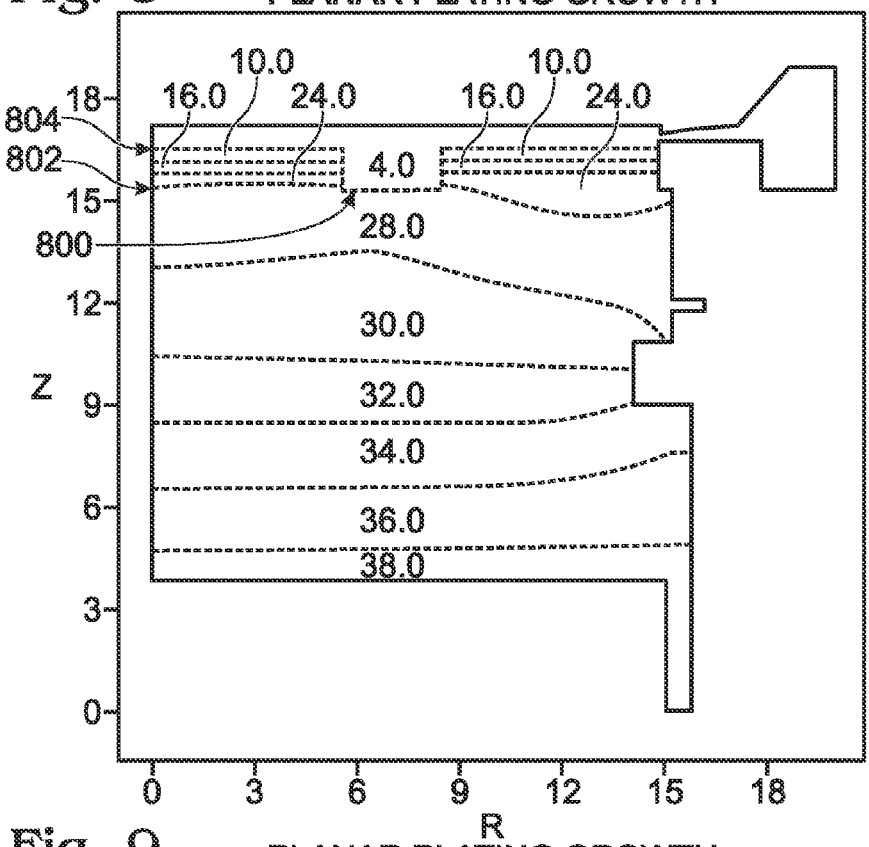
FIG. 8 shows a graphical depiction of a computer modeling of a voltage distribution within the embodiment of FIG. 2 when an air bubble is present on a=a high-resistance virtual anode used as a diffuser barrier.
Figure 9:
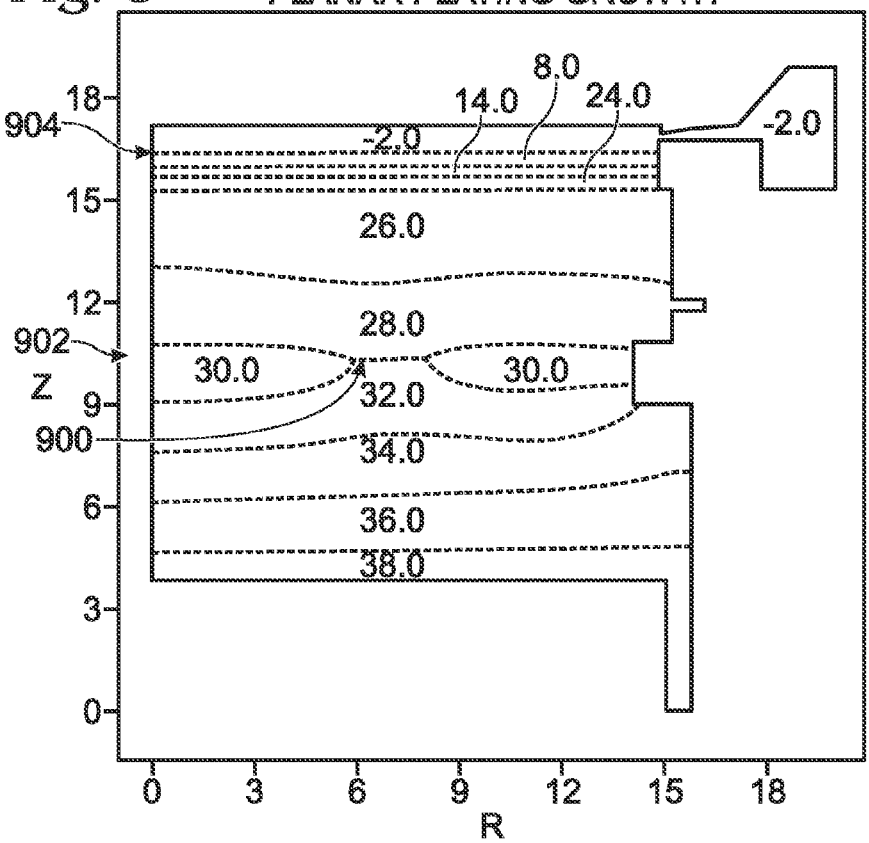
FIG. 9 shows a graphical depiction of a computer modeling of a voltage distribution within the embodiment of FIG. 2 when an air bubble is present on a selective transport membrane.

FIGS. 8-14 show results from computer modeling experiments that illustrate the impact of a bubble blocking flow through portions of an HRVA in a semiconductor electroplating cell. First, FIGS. 8 and 9 show a comparison of the voltage profile in a cell with a bubble trapped under an HRVA diffuser barrier 112 located close to a work piece in the form of a semiconductor wafer compared to that of a cell with a bubble trapped under a selective transport membrane 108 located a farther distance from the wafer surface. In FIG. 8, it can be seen that a bubble (indicated at 800) blocking a portion of the HRVA diffuser barrier (indicated at 802) results in the entire voltage drop occurring at the HRVA plate, rather than at the surface of the wafer (indicated at 804). This may severely impact plating rates in regions of the wafer surface where electrolyte flow is blocked by the bubble. In comparison, it can be seen in FIG. 9 that a bubble (indicated at 900) trapped under the selective transport barrier (indicated at 902) does not cause any noticeable reduction in the voltage drop at the substrate surface (904) as a function of radial position.

Figure 12:
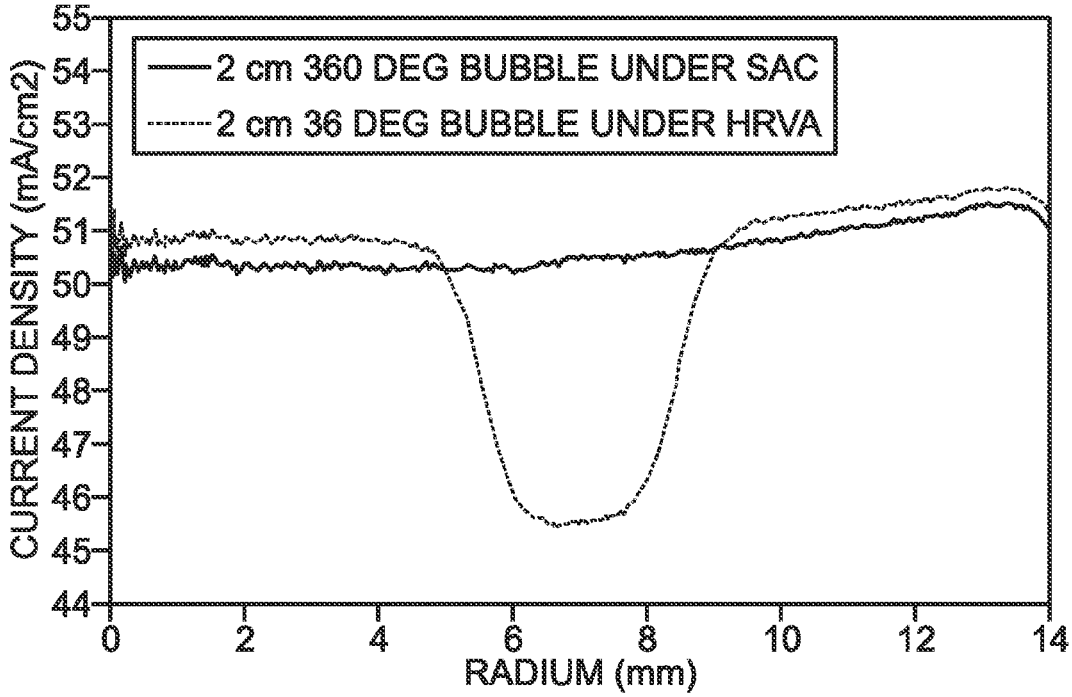
FIG. 12 shows a graphical depiction of a computer modeling of a current density at a wafer surface as a function of radial location when an air bubble is present on the separated anode chamber membrane compared to when an air bubble is present on the high resistance virtual anode.
Figure 10:
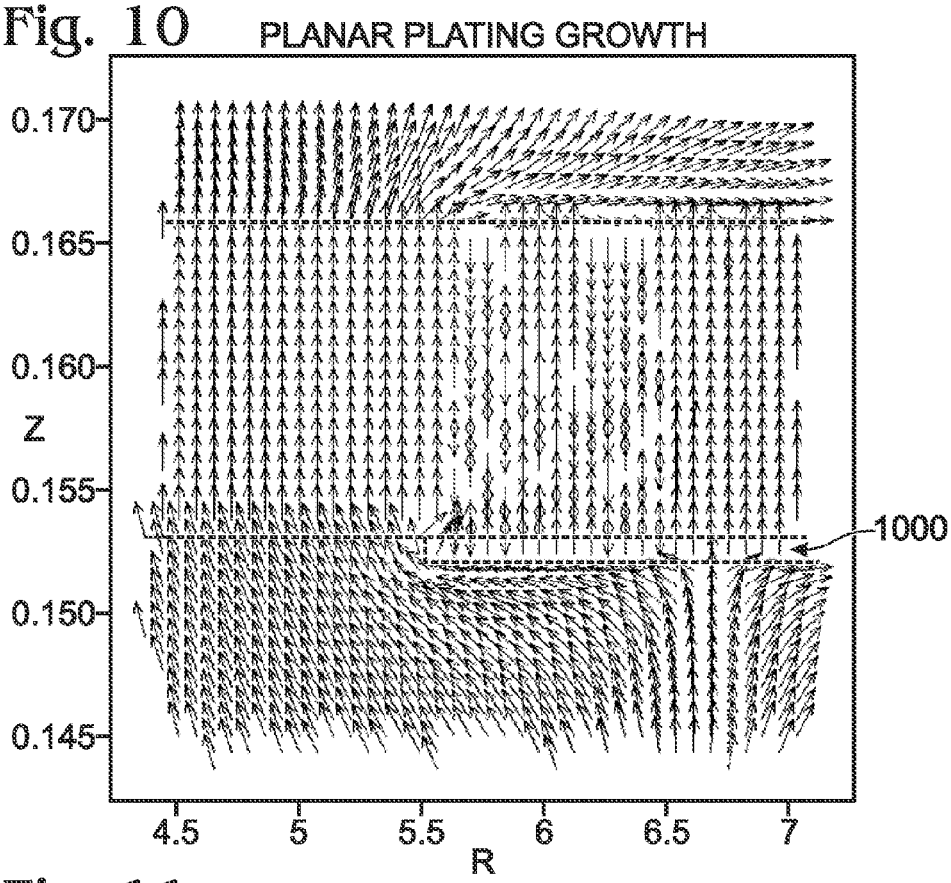
FIG. 10 shows a graphical depiction of a computer modeling of an ionic current distribution within the embodiment of FIG. 2 when an air bubble is present on the high resistance virtual anode.
Figure 11:
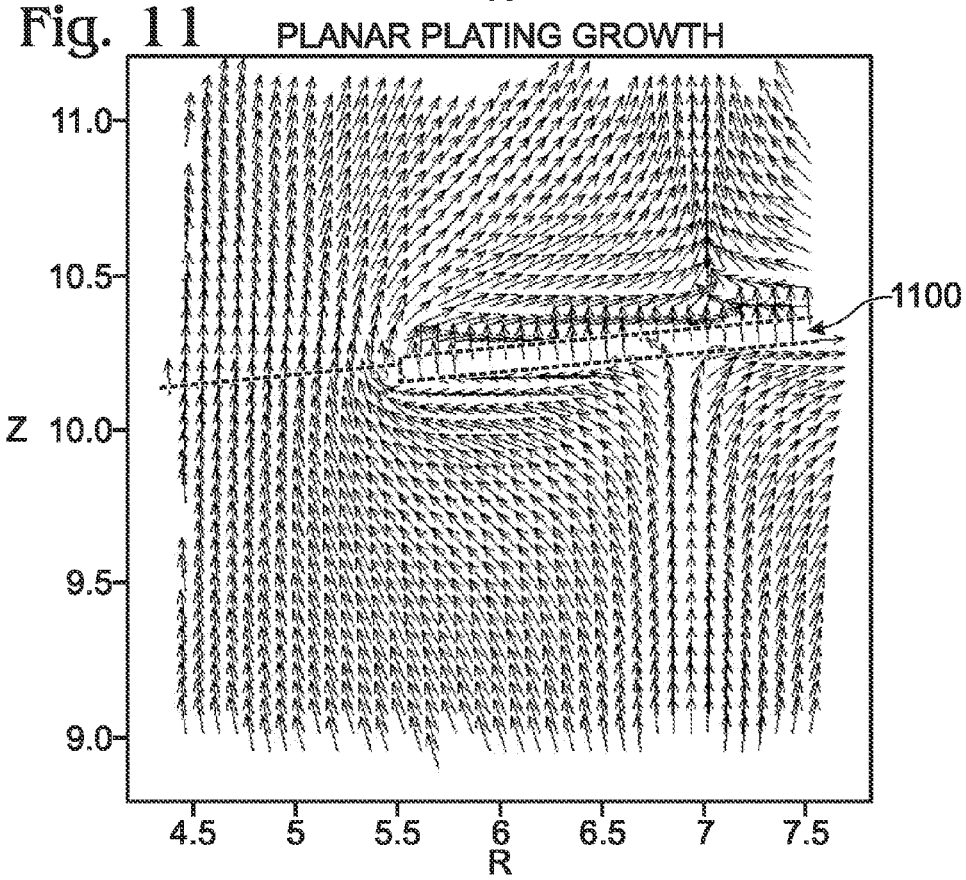
FIG. 11 shows a graphical depiction of a computer modeling of an ionic current distribution within the embodiment of FIG. 2 when an air bubble is present on the selective transport membrane.

Next, FIGS. 10 and 11 show the impact on ionic current through a one-dimensional HRVA partially blocked by a bubble compared to the ionic current through a selective transport barrier partially blocked by a similar bubble. From FIG. 10, it can be seen that ionic current is greatly reduced within the HRVA in the region blocked by the bubble (indicated at 1000). The reduced ionic current flow in the HRVA regions blocked by the bubble may result in plating defects in the corresponding area on the wafer surface, as the closeness of the HRVA to the wafer surface may not permit lateral flow coming out of other portions of the HRVA to compensate for the reduced flow through the blocked portion of the HRVA. In contrast, FIG. 11 shows that ionic current has sufficient space between the selective transport barrier to flow laterally into the plating chamber region behind the blocked portion of the selective transport barrier (indicated at 1100), thereby mitigating the effects of a bubble on the selective transport barrier. FIG. 12 shows a current density at the substrate surface as a function of radial distance for each of these cases. From this figure, it can be seen that a bubble trapped under the HVRA may cause a significant decrease in substrate current density in the region of the bubble, while no such decrease is evident in the case of the bubble trapped under the selective transport barrier.

FIGS. 8-12 collectively show that the potential severity of the impact caused by a bubble trapped underneath a barrier structure in a plating cell may increase as a distance between a work piece surface and the barrier structure decreases. Thus, the vented manifold may be particularly helpful in avoiding problems caused by bubbles where a one-dimensional diffuser barrier, such as a one-dimensional HRVA, is positioned close to a substrate during an electroplating process.

Figure 13:
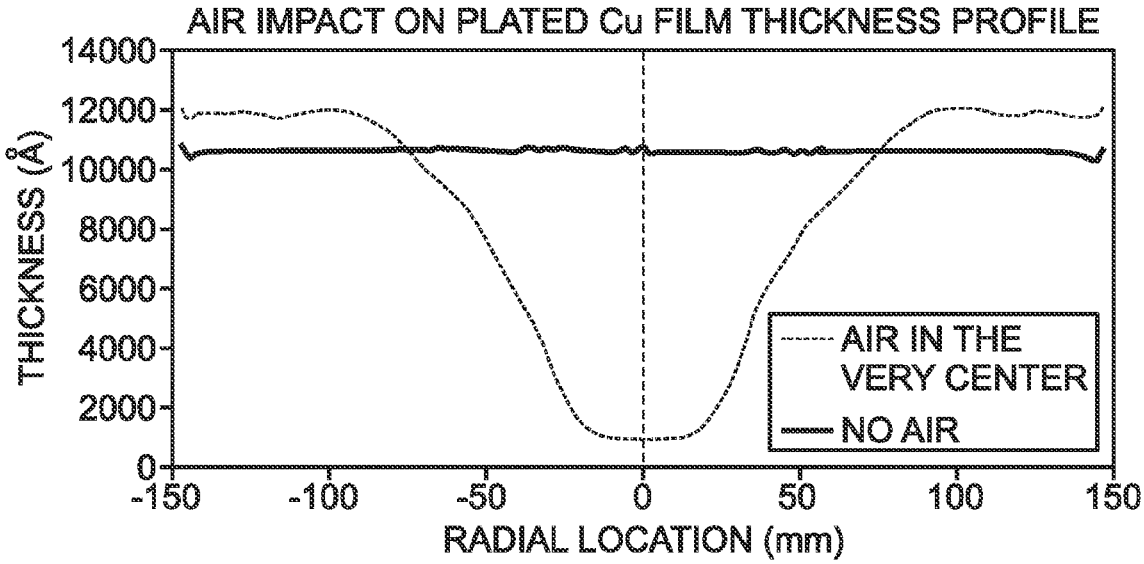
FIG. 13 shows a graphical depiction of a computer modeling of a plated film thickness as a function of radial location when an air bubble is present on a center of the high resistance virtual anode.
Figure 14:
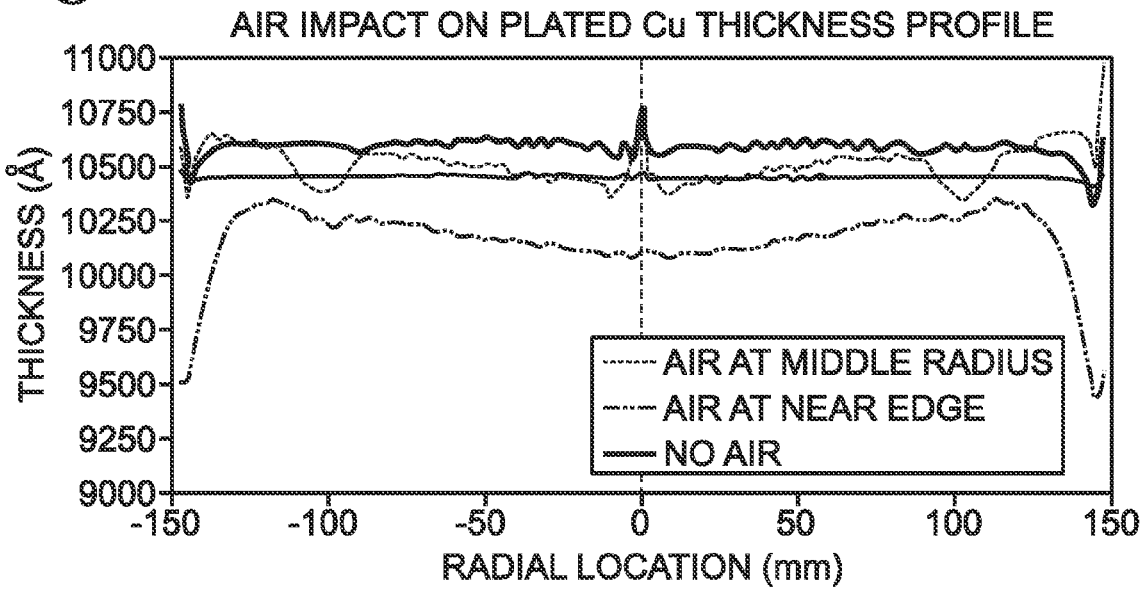
FIG. 14 shows a graphical depiction of a computer modeling of a plated film thickness as a function of radial location when air bubbles are present at mid-radius and at an edge of the high resistance virtual anode.

FIGS. 13-14 show the impact of the position of a bubble on the HRVA on the thickness profile of a plated Cu film on a work piece in the form of a semiconductor wafer. First, FIG. 13 shows the effect of a bubble in the center of the HRVA. As can be seen, the HRVA center bubble results in essentially no plating on the center of a wafer. FIG. 14 shows the effect of a bubble located at mid-radius and at an edge of the HRVA. In both cases, the bubble is shown to lead to thinner plating in the region of the bubble. Therefore, the removal of bubbles from the electrolyte prior to introducing the electrolyte to the plating chamber upstream of the HRVA may help to avoid bubbles becoming trapped under the HRVA, and therefore may help to avoid such defects.

Figure 15:
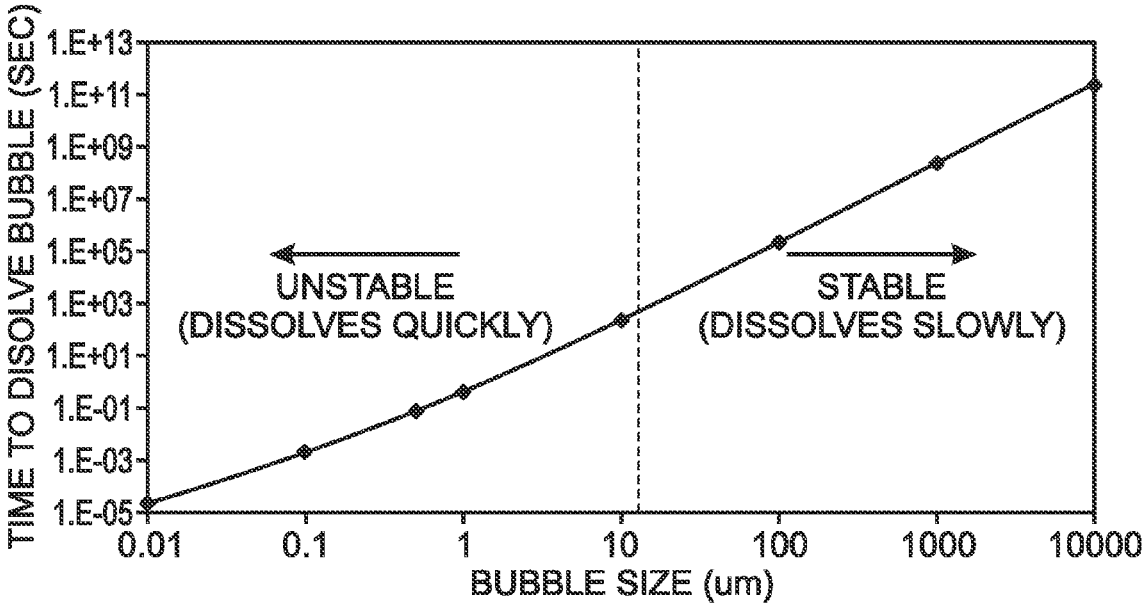
FIG. 15 shows a plot of air bubble dissolution time as a function of air bubble size.

It will be appreciated that not all bubbles pose the problems illustrated in FIGS. 8-14. For example, bubbles that are smaller than the HRVA (or other diffuser barrier) through-holes may pass through the HRVA without causing problems. Due to their small size, such bubbles also are likely to rise too slowly to reach the cathode surface and cause related plating defects. Instead, such bubbles may remain in the electrolyte flow over the weir wall and out of the plating cell without causing problems. Further, very small bubbles may be unstable, and dissolve into the electrolyte in a relatively short period of time. FIG. 15 shows a plot of bubble lifetime as a function of bubble size in an example copper electroplating solution. From this plot, it can be seen that bubbles less than about 10-15 microns in size may dissolve sufficiently quickly not to have more than a transient effect on an electroplating system, in light of total plating times (for example, around 60 seconds in some embodiments), fluid travel times (for example, around 30 seconds between entering the plating cell and exiting through the HRVA), and total plating cycle time between wafers (for example, around 120 seconds in some embodiments) encountered in some systems. In light of this factor in combination with the small size of the bubbles, which are smaller than the HRVA through-holes, such bubbles to be removed from an electrolyte by dissolution during normal circulation of the electrolyte, instead of separation.

Figure 16:
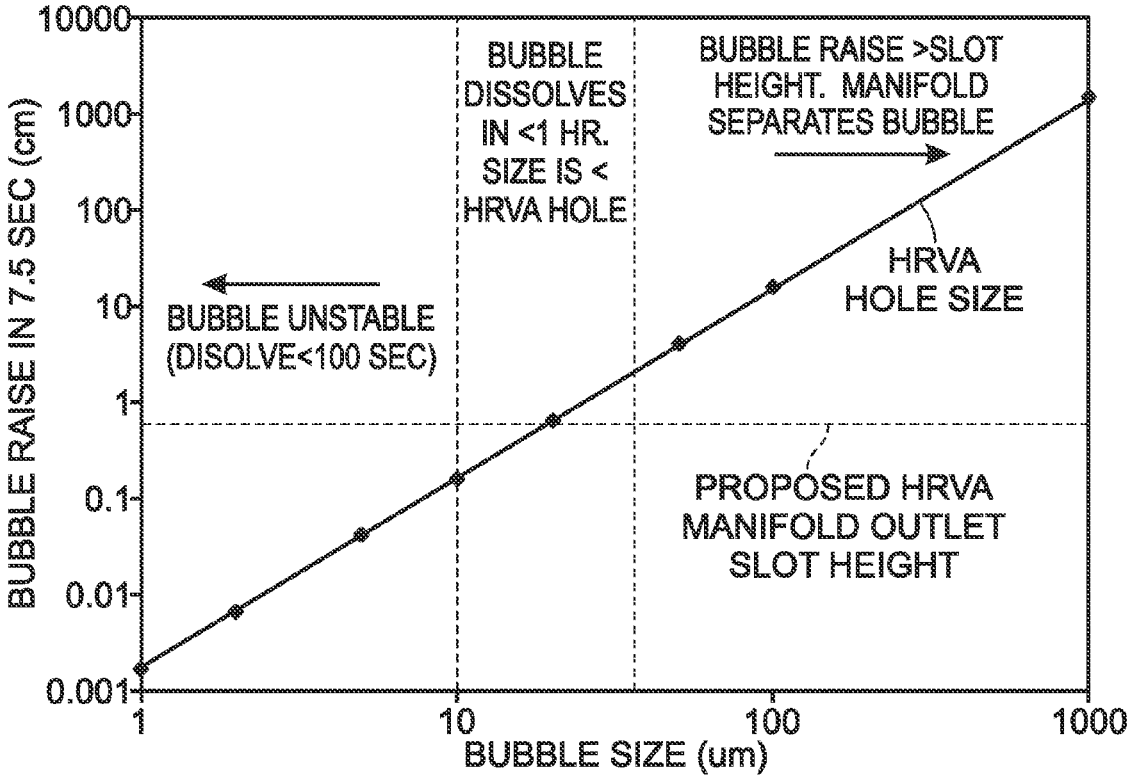
FIG. 16 shows a plot of air bubble rise distance as a function of air bubble size.

Bubbles larger than this may be sufficiently stable such that removal by separation is more efficient than removal by dissolution. However, referring next to FIG. 16, the HRVA (or other diffuser barrier) through-holes of the depicted embodiment have a significantly larger diameter than 10-15 microns. Therefore, there may be a size range of stable, long-lived bubbles that do not pose problems because the bubbles can pass through the HRVA. Therefore, these bubbles may or may not be removed via the vented manifold in various embodiments.

On the other hand, bubbles larger than the HRVA through-holes may be stable enough that the bubbles do not dissolve into the electrolyte at an appreciable rate, and also may become trapped beneath the HRVA. Therefore, the vented electrolyte manifold may be configured to remove these bubbles from the electrolyte. In order to separate such bubbles from the electrolyte prior to delivery of the electrolyte into the plating chamber, the bubbles need sufficient time to rise higher in the electrolyte flow than the height of the electrolyte delivery openings that deliver electrolyte from the vented manifold into the plating chamber. In the specific embodiment shown in FIG. 16, it is assumed for the purpose of example that electrolyte flows from the outlet of the electrolyte feed tubes 204 to the electrolyte delivery openings 224 (i.e. the length of the vented manifold flow path) in an average of 7.5 seconds. The actual average time will depend on the design of the manifold, specifically the volume between the inlet and outlet, and the flow rate. As a further way of example, if the flow rate into the system were 10 liters per minute, the flow were divided into 6 inlet location into the vented manifold region (so the inlet flow to each section were 1.67 liter per minute), and the volume between the inlet and the outlet were 221 $cm^3$, the average time in the manifold section would be approximately 7.5 seconds.

In this example, it is desired for a bubble large enough to block the HRVA to rise more than the electrolyte delivery opening height in 7.5 seconds so that it can be removed and vented out through outlet 226 rather than the HRVA chamber inlet 224. From FIG. 16, it can be seen that a bubble the size of the HRVA through-holes rises over 100 cm in 7.5 seconds. Therefore, such bubbles can be separated by the disclosed vented electrolyte manifold, as the vertical distance between inlet slot (or other structure) and the vent of the vented manifold is generally much lower than this rise distance, and is less than 1 cm in some embodiments.

In some embodiments, such as embodiments with relatively smaller diffuser barrier through-holes, it may be desired to separate smaller bubbles with slower rise times from the electrolyte that may rise too slowly for removal by the vented electrolyte manifold. In such embodiments, an additional bubble removal structure may be included in the vented electrolyte manifold. For example, one embodiment may provide a two-part de-bubbler stage. In such an embodiment, a first de-bubbler stage may remove larger bubbles via buoyancy, as described above. Then, a second de-bubbler stage may comprise a bubble removal filter configured to remove any bubbles that are not removed in the buoyancy separation stage, and/or to break up larger bubbles into smaller bubbles that can pass through the diffuser barrier without being trapped.

Any suitable structure may be used for such bubble removal filter. For example, in some embodiments, the bubble removal filter may comprise a porous material with a pore size that is equal to or smaller than the diameter of the diffuser barrier through-holes. In some embodiments, the filter may be made from a hydrophilic material that is wet by the electrolyte, thereby causing the electrolyte to reject gas bubbles. In embodiments, the filter may be made from a material that is hydrophobic but that adsorbs bubble gases to allow bubbles to coalesce, and therefore to rise more quickly to a vent opening. In one more specific embodiment, the bubble removal filter comprises a polysulphone filter with a pore size less than the size of the diffuser barrier through-holes and that is placed over the electrolyte delivery openings in the vented manifold. In this manner, the bubble removal filter is the last structure that the electrolyte passes through prior to entering the plating chamber. Because the filter pores are smaller than the diffuser barrier through-holes, only bubbles smaller than the diffuser barrier through-holes pass through the bubble removal filter. Such bubbles do not accumulate in front of or block diffuser barrier through-holes, but instead tend to travel through the diffuser barrier and then radially outwardly through the space between the diffuser barrier and the substrate above.

It be understood that the configurations and/or approaches described herein are exemplary in nature, and that these specific embodiments or examples are not to be considered in a limiting sense, because numerous variations are possible. The subject matter of the present disclosure includes all novel and nonobvious combinations and subcombinations of the various processes, systems and configurations, and other features, functions, acts, and/or properties disclosed herein, as well as any and all equivalents thereof.

The invention claimed is:

1. An apparatus for electroplating a layer of metal onto a conductive seed layer on a work piece, the apparatus comprising:

a plating chamber configured to hold an electrolyte;

a work piece holder configured to hold the work piece in the plating chamber during an electroplating process;

a cathode contact associated with the work piece holder, the cathode contact being configured to electrically contact the work piece during plating;

an anode contact configured to electrically contact an anode disposed in the plating chamber;

a diffusing barrier disposed between the cathode contact and the anode contact;

an electrolyte delivery path for delivering electrolyte to the plating chamber upstream of the diffusing barrier;

an electrolyte return path for delivering electrolyte away from the plating chamber downstream of the diffusing barrier; and a vented electrolyte manifold disposed in the electrolyte delivery path immediately upstream from the plating chamber, the vented electrolyte manifold comprising one or more electrolyte delivery openings that open to the plating chamber, one or more vents that open to a location other than the plating chamber, a quiescent stage, and a de-bubbler stage separated from the quiescent stage by a wall configured to reduce electrolyte turbulence before the electrolyte enters the de-bubbler stage, the wall including one or more openings permitting passage of electrolyte between the quiescent stage and the de-bubbler stage wherein the wall is at a slanted angled towards an electrolyte feed tube configured to deliver electrolyte to a bottom of the vented manifold, and wherein the one or more openings of the wall are azimuthally spaced from the electrolyte feed tube.

2. The apparatus of claim 1, wherein each of the one or more vents is located in the de-bubbler stage and is azimuthally separated from each of the one or more openings in the wall.

3. The apparatus of claim 1, wherein each of the one or more electrolyte delivery openings is located in the de-bubbler stage and is azimuthally separated from each of the one or more openings in the wall.

4. The apparatus of claim 1, wherein each of the one or more electrolyte delivery openings is located in the vented manifold at a lower position than each of the one or more vents.

5. The apparatus of claim 1, wherein the plating chamber comprises a weir wall over which electrolyte flows to reach the electrolyte return path, and wherein each of the one or more vents opens to the electrolyte return path is located at a location spaced from a perimeter of the weir wall.

6. The apparatus of claim 5, wherein each of the one or more vents opens to the electrolyte return path at a corresponding tab that extends outwardly from the weir wall.

7. The apparatus of claim 1, wherein the diffusing barrier comprises a high resistance virtual anode comprising a plurality of holes formed through a plate.

8. The apparatus of claim 7, wherein the high resistance virtual anode comprises a plurality of one-dimensional through-holes.

9. The apparatus of claim 1, wherein the vented manifold is located immediately upstream from the diffusing barrier.

10. The apparatus of claim 1, wherein the one or more vents open to the electrolyte return path.

11. An apparatus for electroplating a layer of metal onto a conductive seed layer on a work piece, the apparatus comprising:

a plating chamber comprising an anode chamber and a cathode chamber;

a work piece holder configured to hold the work piece in the plating chamber during an electroplating process;

a cathode contact associated with the work piece holder, the cathode contact configured to electrically contact the work piece during plating;

an anode contact configured to electrically contact an anode disposed in the plating chamber;

a diffusing barrier disposed between the cathode contact and the anode contact;

a vented electrolyte manifold integrated into the anode chamber and configured to deliver electrolyte to the plating chamber, the vented electrolyte manifold comprising a quiescent stage, a de-bubbler stage, the quiescent stage configured to receive a higher velocity flow of electrolyte and to provide a lower velocity laminar flow of electrolyte to the de-bubbler stage, and the de-bubbler stage comprising one or more vents configured to remove bubbles from the electrolyte, one or more electrolyte delivery openings configured to deliver electrolyte to the plating chamber, and a wall separating the quiescent stage and the de-bubbler stage, the wall including at least one slit proximate to a top of the wall, the wall angled from a bottom of the manifold to a top of the manifold away from the one or more electrolyte delivery openings; and at least one electrolyte feed tube configured to feed an electrolyte flow to the quiescent stage of the vented manifold, each slit being azimuthally spaced from each electrolyte feed tube.

12. The apparatus of claim 11, wherein each of the one or more vents is located at a location in the vented electrolyte manifold higher than each electrolyte delivery opening.

13. The apparatus of claim 11, wherein the wall is configured to reduce electrolyte turbulence before the electrolyte enters the de-bubbler stage.

14. The apparatus of claim 11, wherein the one or more electrolyte feed tubes are configured to feed the electrolyte flow to the quiescent stage of the vented manifold by impinging the electrolyte flow against the slanted wall.

15. The apparatus of claim 11, further comprising a bubble filter in a position such that electrolyte passes through the bubble filter before entering the plating chamber.

16. An apparatus for electroplating a layer of metal onto a conductive seed layer on a work piece, the apparatus comprising:

a plating chamber;

a work piece holder configured to hold the work piece in the plating chamber during an electroplating process;

a cathode contact associated with the work piece holder, the cathode contact being configured to electrically contact a seed layer on the work piece at a location adjacent to an edge of the work piece;

an anode contact configured to electrically contact an anode disposed in the plating chamber;

a diffusing barrier disposed along an ionic path between the cathode contact and the anode contact;

an electrolyte delivery path for delivering electrolyte to the plating chamber upstream of the diffusing barrier;

an electrolyte return path for delivering away from the plating chamber electrolyte that flows over an electrolyte weir that forms an upper edge of the plating chamber; and a vented electrolyte manifold disposed in the electrolyte delivery path immediately upstream from the plating chamber, the vented electrolyte manifold comprising a quiescent stage configured to receive electrolyte from an electrolyte feed tube, a de-bubbler stage, one or more electrolyte delivery openings that open to the plating chamber, wherein the electrolyte delivery path is an azimuthal electrolyte flow path extending between an electrolyte feed tube and the one or more electrolyte delivery openings, a wall separating the quiescent stage and the de-bubbler stage, the wall angled from a bottom of the vented electrolyte manifold to a top of the electrolyte manifold away from the one or more electrolyte delivery openings, and one or more vents that open to the electrolyte return path at a location spaced from a perimeter of the electrolyte weir.

17. The apparatus of claim 16, wherein each of the one or more vents opens to the electrolyte return path at a tab that extends outwardly from a perimeter of the electrolyte weir.

18. The apparatus of claim 17, further comprising a plurality of vents and a plurality of tabs extending from a perimeter of the electrolyte weir, each of the one or more vents opening to the electrolyte return path at a corresponding tab.

19. A device configured to reduce bubbles in an electroplating apparatus comprising an electrolyte delivery path including a plating chamber and an electrolyte feed tube when the device is in the electrolyte delivery path immediately upstream from the plating chamber, the device comprising:

a bottom;

a top;

an electrolyte entry aperture configured to receive fluid from the electrolyte feed tube;

an electrolyte exit aperture configured to deliver electrolyte into the plating chamber;

a quiescent stage comprising the electrolyte entry aperture;

a de-bubbler stage in fluid communication with the quiescent stage, the de-bubbler stage comprising the exit aperture proximate to the bottom;

a wall between the quiescent and de-bubbler stages, the wall angled from the bottom to the top away from the electrolyte exit aperture, wherein the wall comprises one or more openings azimuthally aced from the electrolyte entry aperture; and a vent open to an area other than the plating chamber.

20. The device of claim 19, wherein the quiescent stage is configured to reduce turbulence of electrolyte flow from the electrolyte feed tube before the electrolyte exits the quiescent stage.

21. The device of claim 19, wherein the quiescent stage is configured to convert flow of the electrolyte to laminar flow before the electrolyte exits the quiescent stage.

22. The device of claim 19, wherein the quiescent stage comprises a larger cross-sectional area than the entry aperture.

23. The device of claim 19, wherein an angle of the wall is configured to reduce turbulence of flow of the electrolyte as the electrolyte flows into the de-bubbler stage.

24. The device of claim 19, wherein the electrolyte entry aperture is proximate to the bottom.

* * * * *

UNITED STATES PATENT AND TRADEMARK OFFICE

CERTIFICATE OF CORRECTION

PATENT NO. : 8,475,637 B2
APPLICATION NO. : 12/337147
DATED : July 2, 2013
INVENTOR(S) : Jingbin Feng et al.

It is certified that error appears in the above-identified patent and that said Letters Patent is hereby corrected as shown below:

In the Claims

At Column 12, Line 30, in Claim 1, change “stage” to --stage,--.

At Column 14, Line 47, in Claim 19, change “aced” to --spaced--.

Signed and Sealed this
Third Day of December, 2013

Margaret A. Focarino

Margaret A. Focarino
*Commissioner for Patents of the United States Patent and Trademark Office*